United States Patent [19]

Massion et al.

[11] 4,282,907

[45] Aug. 11, 1981

[54] TENSION SENSING MECHANISM FOR STRAPPING TOOL

[75] Inventors: Robert J. Massion, Woodstock; Peter Lems, Wilmette; Robert J. Nix, Park Ridge, all of Ill.

[73] Assignee: Signode Corporation, Glenview, Ill.

[21] Appl. No.: 83,455

[22] Filed: Oct. 10, 1979

[51] Int. Cl.[3] ..... B21F 9/02; B21F 45/00

[52] U.S. Cl. ..... 140/93.4; 140/123.5

[58] Field of Search ..... 140/93.2, 93.4, 123.5

[56] References Cited

U.S. PATENT DOCUMENTS

| | | | |
|---|---|---|---|
| 3,198,218 | 8/1965 | Ericsson et al. | 140/93.4 |
| 3,506,041 | 4/1970 | Angarola | 140/93.4 |
| 3,863,684 | 2/1975 | Simmons | 140/93.4 |
| 4,015,643 | 4/1977 | Cheung | 140/93.4 |

*Primary Examiner*—Richard B. Lazarus

*Attorney, Agent, or Firm*—Dressler, Goldsmith, Shore, Sutker & Milnamow, Ltd.

[57] ABSTRACT

A strapping tool for tensioning a loop of strap having first and second strap portions about an article is provided with a tension sensing mechanism which includes a gripper member for gripping the second strap portion and restraining it from movement during tensioning of the loop. A first arm is pivotally mounted to the tool frame for pivoting movement in a first direction and in a second, opposite direction. A first spring biases the first arm in the first direction. A second arm is pivotally mounted on the first arm for pivoting movement in the first and second directions away from and towards the strap portions, respectively. A second biasing spring is provided for biasing the second arm in the second direction. A tensioning wheel is mounted on the second arm for being pivoted with the second arm to engage the first strap portion and for being operated to tension the loop when the second strap portion is restrained by the gripper whereby, at a predetermined tension level, the loop tension reaction force transmitted from the second arm to the first arm urges the first arm to overcome the first spring and pivot relative to the frame in the second direction. A control means is provided for responding to the pivoting movement of the first arm in the second direction for terminating the operation of the tensioning wheel at the predetermined loop tension level.

16 Claims, 11 Drawing Figures

TENSION SENSING MECHANISM FOR STRAPPING TOOL

DESCRIPTION

Technical Field

This invention relates to tools for tensioning a loop of strap or other ligature tightly around an article to a predetermined tension level.

BACKGROUND OF THE INVENTION

The assembly of the present invention is particularly well suited for certain types of strapping tools wherein a tensioning means, such as a motor driven tension wheel, is brought into contact with one of the overlapping strap ends of the strap loop and rotated to pull that strap end to constrict the loop about the package. Such tools typically draw tension in the loop to a predetermined or preset level and then subsequently crimp a seal about the overlapping strap ends and sever the trailing portion of the strap. Examples of such tools are described in the U.S. Pat. No. 3,506,041 to Angarola, and the U.S. Pat. No. 3,198,218 to Ericsson et al.

With tools of the type described above, mechanisms have been devised to automatically sense the tension level in the loop and to terminate the tensioning when that level is reached. In the tool described in the aforementioned Angarola patent, the tensioning action is terminated when a predetermined resistance torque in the strap tensioning wheel is encountered. This corresponds approximately to the desired final loop tension level. Specifically, the supply pressure to an air motor is controlled such that, at the desired tension, the supply pressure can no longer rotate the output shaft of the motor to turn the feed wheel against the loop tension and the motor "stalls." Further, in the tool described in the Angarola patent the subsequent strap severing and seal-crimping actions are effected in response to the sensing of a predetermined back-up pressure in the air supply line leading to the tensioning motor when the air motor stalls or approaches stall.

Although the tool described in the aforementioned Angarola patent functions well under a variety of conditions with many types of strap, it would be desirable to provide a more direct control of the termination of the tensioning sequence and of the initiation of the strap severing and seal-crimping sequences rather than to rely upon sensing of air pressures in the tool.

It would be desirable to provide a strapping tool having an air motor actuatable by depressing a lever which opens a valve to supply air to the air motor. It would be advantageous if the valve could be subsequently automatically latched in this open position so that the operator can then release the lever while the strap loop is automatically tensioned. After the preset tension level has been reached, the valve would preferably be automatically unlatched to terminate the tensioning. However, where low elongation strap is used and where the strap is pulled relatively tightly around an article by hand before initiating the tensioning cycle, it is possible that the operator might not be able to release the lever quickly enough to allow the valve to open upon automatic release of the hold down latch. In this situation the air motor would then tension the loop beyond the desired preset tension level. Thus, it would be desirable to provide an actuation system that would permit the tension motor to be automatically stopped when the preset tension level is reached even if the operator is still depressing the actuating lever.

SUMMARY OF THE INVENTION

In the preferred embodiment of the tension sensing mechanism of the present invention, a strapping tool is provided with a frame, a gripper on the frame for holding the first of two overlapping strap portions, and a first arm pivotally mounted to the frame for pivoting movement in first and second directions. A first spring is provided for biasing the first arm in the first direction and a second arm is pivotally mounted on the first arm for pivoting movement in the first and second directions away from and toward the overlapping strap portions, respectively. A second spring is provided for biasing the second arm in the second direction and a tensioning air motor is mounted on the second arm for being pivoted with the second arm to engage the first strap portion and for being operated to tension the loop when the second strapping portion is restrained by the gripper. At a predetermined tension level, the loop tension reaction force transmitted from the second arm to the first arm urges the first arm to overcome the first biasing spring and pivot relative to the frame in the second direction. The tool includes a control means responsive to the pivoting movement of the first arm in the second direction for terminating the operation of the tensioning motor at the predetermined loop tension level.

Thus, it is seen that with the novel tension sensing mechanism of the present invention, the tension in the strap loop is sensed by direct mechanical engagement with the strap, thus eliminating the need to rely upon air motor stall or measurements of pneumatic line pressures. Thus, the invention could function with an electric tensioning motor instead of a pneumatic motor.

In the preferred embodiment, the present invention further includes a pneumatically operated tension motor and pneumatic control system wherein the motor is initially actuated to begin tensioning by changing the position of a valve in the air motor supply line. In particular, the valve is designed to be operated by the depression of an actuating lever wherein the valve does not pass air to the tension motor until the lever is released after first being depressed. This allows the tension motor to be automatically terminated when the predetermined loop tension level is reached—even in those cases where the tension level is reached very rapidly, e.g., within a fraction of a second.

In the preferred embodiment, the tool cycling time is thus relatively short and yet the tool is able to sense the strap loop tension with improved accuracy. The functioning of the tension sensing mechanism is not significantly affected by strap surface texture or contaminants. Nor is it affected by variations in the air motor air supply pressure. Further, the desired final loop tension can be simply set by making an easy adjustment of the first arm spring compression. This eliminates the need for less accurate adjustment mechanisms, such as air regulators, throttling valves, and pressure relief valves found in some prior art tools.

A novel combination of elements in accordance with the present invention is thus seen to yield desirable and beneficial results—results which are not only new and different, but which also provide a substantial improvement over the prior art.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification and in which like numerals are employed to designate like parts throughout the same.

DESCRIPTION OF THE PREFERRED EMBODIMENT

This invention may be used in many different forms. This specification and the accompanying drawings disclose only one specific form as an example of the use of the invention. The invention is not intended to be limited to the embodiment illustrated, and the scope of the invention will be pointed out in the appended claims.

The precise shapes and sizes of the components herein described are not essential to the invention unless otherwise indicated.

For ease of description, the apparatus of this invention will be described in normal operating position, and terms such as upper, lower, horizontal, etc., will be used with reference to this normal operating position. It will be understood, however, that the apparatus of this invention may be manufactured, stored, transported and sold in an orientation other than the normal operating position described.

The apparatus of this invention has certain conventional mechanisms, the details of which, though not fully illustrated or described, will be apparent to those having skill in the art and an understanding of the necessary functions of such mechanisms.

Figure 1:
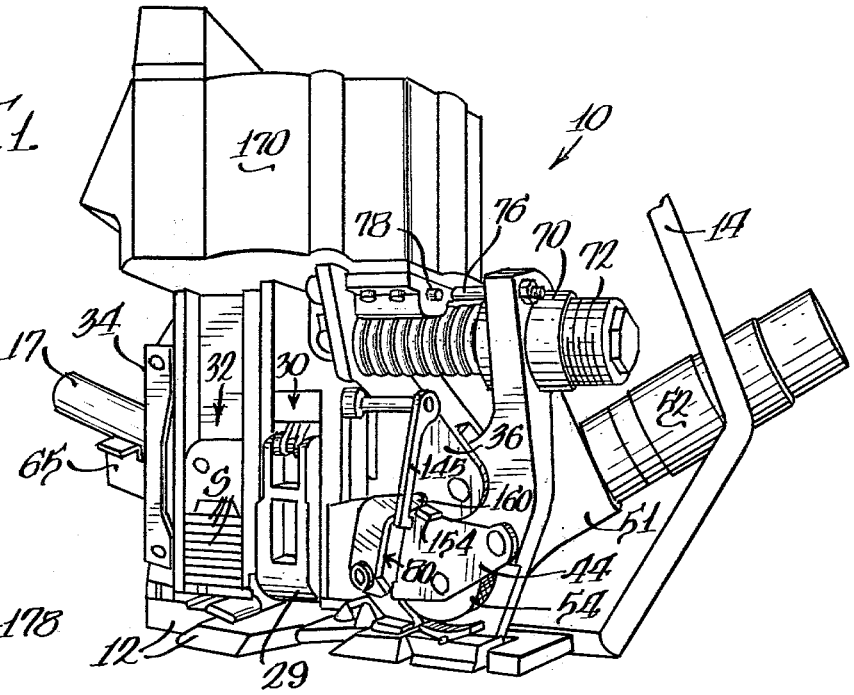
FIG. 1 is a perspective view of the relevant parts of a strapping tool shown equipped with the tension sensing mechanism in accordance with the present invention and ready to receive the overlapping strap ends of a loop strap.

Referring now to the drawings, in FIG. 1, the relevant elements of a strap tensioning and sealing tool 10, in which the present invention is incorporated, are shown. The novel mechanisms of the present invention, in the embodiment illustrated, are specifically adapted for use with, and are incorporated in, a modification of the strapping tool illustrated and described in the U.S. Pat. No. 3,506,041 to Angarola. Hence, a number of the mechanisms of the strapping tool 10 are identical to those illustrated in that patent and operate in the same manner. For a full understanding of the nature and operation of the Angarola tool, reference may be had to that patent (and to the aforementioned U.S. Pat. No. 3,198,218 to Ericsson et al. cited therein). In this description, only such portions of the tool as are relevant to the present invention have been illustrated, these portions being described only in sufficient detail as to afford an understanding of the relation to the present invention. However, the entire disclosure of the Angarola patent, insofar as it is consistent with the present disclosure is hereby incorporated in and made a part of the application by reference thereto. Such modifications as are necessary to adapt the Angarola tool to the present invention are described in detail hereinafter.

The tool 10 includes the usual frame or foot assembly 12, a hanger 14 from which the tool may be suspended, and an auxiliary handle 17 fixedly secured to the frame 12. As best illustrated in FIG. 2, the base 12 is adapted to be supported on an article P undergoing strapping with a flat strap 31 and has a suitable gap or void 24 to permit entry of jaws 29 associated with the sealing mechanism 30 for the purpose of applying and crimping a conventional metal seal S around a first or lower overlapping strap end portion L and a second or upper overlapping strap end portion U.

A series of stacked seals S are disposed in a seal magazine 32 and are adapted to be fed successively to the jaws of the sealing mechanism 30 by means of a conventional ejector arm 34 which engages the lowermost seal in the stack and pushes the same endwise between the jaws, all in the manner described in detail in the aforementioned Angarola patent. The jaw sealing mechanism 30 also carries a conventional cutter blade 33 (FIG. 2) for severing the excess strap from the sealed loop.

The tool is also provided with a conventional holding gripper member 66 which serves to anchor the lower strap end portion L at the time of initial loading of the tool. The holding gripper 66 is raised and lowered by a depressable spring biased lever 65 as explained in detail in the aforementioned Angarola patent.

Figure 2:
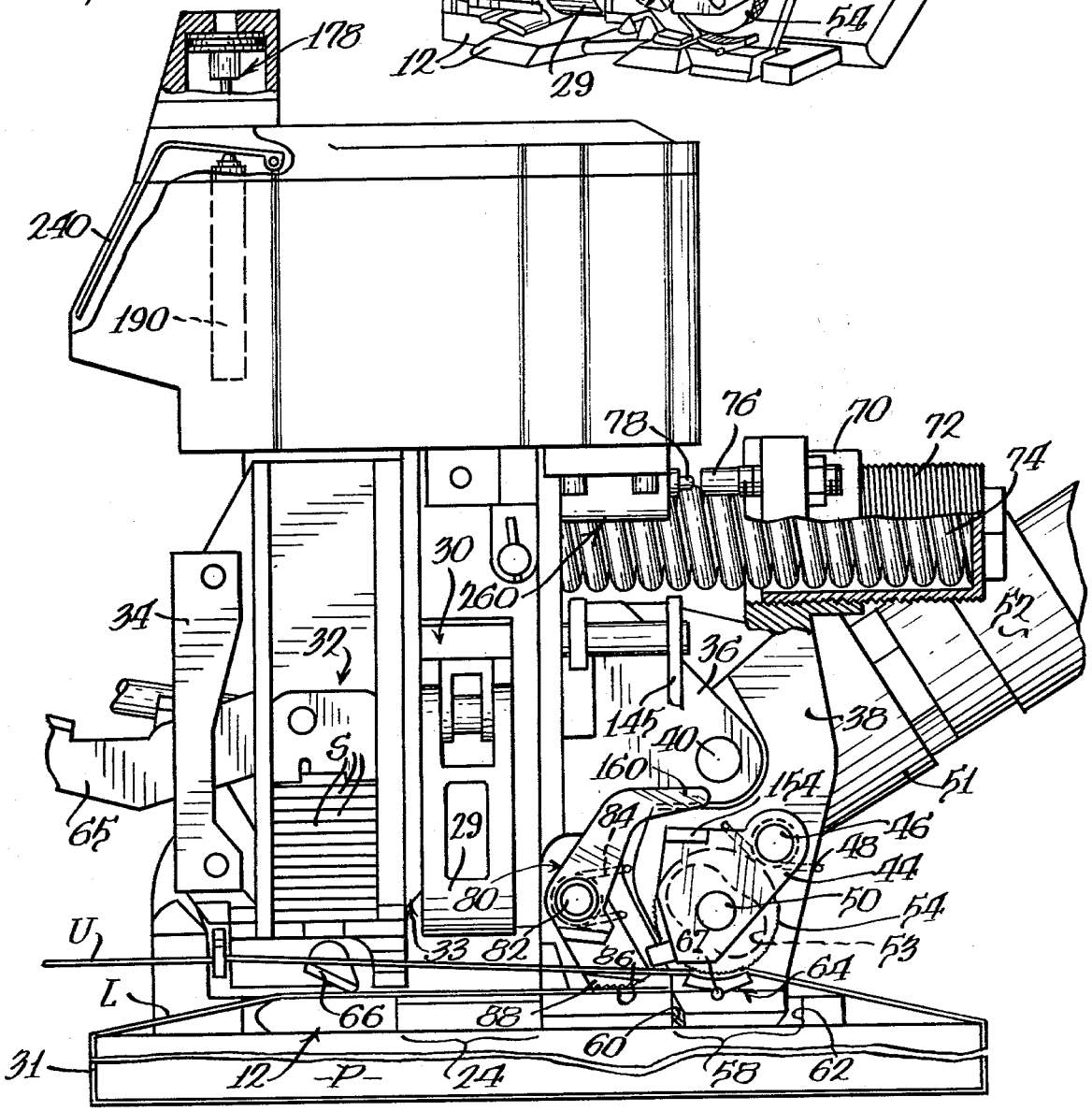
FIG. 2 is an enlarged, fragmentary, side view with certain portions of the exterior of the tool cut away to more clearly illustrate the interior mechanisms and with the tool engaged with a strap loop around a package.

In accordance with the present invention, the strapping tool described in the aforementioned Angarola patent is preferably modified as illustrated in FIGS. 1 and 2 to provide a bifuracated projection 36 to which is mounted a first pivot arm 38 by means of pin 40. A second or tension wheel arm 44 is pivotally mounted about pin 46 to the first arm 38 and is biased counterclockwise about pin 46 by spring 48. The second arm 44 carries a shaft assembly 50 to which is connected an air-operated tensioning motor 52 and a tension wheel 54 adapted to be rotated in a clockwise direction (as viewed in FIG. 2) by the motor 52. The motor 52 is pivotally mounted to pin 46. The motor 52 is thus pivotable relative to arm 38. To accommodate the movement of the tension wheel 54 and shaft 50 during the pivoting movement of the motor 52 and the second arm 44, the first arm 38 is provided with a suitable elongate aperture 53.

The motor 52 is typically operatively connected through a gear reduction device 51. The structure and operation of the motor 52, gear reduction device 51, and tension wheel 54 are conventional and are fully described in the aforementioned Angarola patent.

The forward bottom portion of frame 12 has a gap 58 defined between two laterally projecting surfaces 60 and 62 for receiving the distal end of the first arm 38. The surface 60 functions as a first stop means for limiting the pivoting movement of the first arm 38 in a first, clockwise, direction and the surface 62 functions as a second stop means for limiting the pivoting movement of the first arm 38 in the second, counterclockwise, direction.

The arm 38 also carries a pivotal wear plug 64 which is mounted for rotation about pin 67 secured to the first arm 38. The wear plug 64 is adapted to cooperate with the tension wheel 54 for gripping the upper strap portion U when the tension wheel 54 is pivoted by the second arm 44 downwardly against the strap and wear plug 64 under the urging of the torsion spring 48.

The upper end of the first arm 38 is formed with an annular portion 70 which is internally threaded and engaged with the externally threaded cylindrical end cap member 72 which engages one end of a compression spring 74, the other end of which spring abuts frame 12 at the front of the sealing mechanism 30 and which is suitably secured thereto. The spring 74 thus urges the pivot arm 38 in a clockwise direction about pin 40 to the orientation illustrated in FIG. 2 wherein the first arm 38 is engaged with the first stop surface 60. The compression of spring 74 can be adjusted by threading the end cap member 72 relative to the first arm 38 along the longitudinal axis of the spring. As will become apparent from the description of the detailed operation of the tool hereinafter, the compression setting of spring 74 determines the maximum tension that will be drawn in the strap loop about the package P.

The arm 38 carries a pin 76 which is adapted to be moved against a valve actuating pin 78, associated with the tension limit valve to be described in detail hereinafter, when the first arm 38 is pivoted in the counterclockwise direction (as viewed in FIG. 2). Actuation of pin 78 results in the termination of the tensioning process and in the initiation of the strap severing and sealing cycle in a manner which will be explained in detail heareinafter.

An essential modification of the strapping tool illustrated in the aforementioned Angarola patent involves 1) the elimination of the lower or overlapping strap end portion L from engagement with the pivotal wear plug 64 and 2) the provision of a lower strap end gripper 80 which is pivotally mounted about a shaft 82 to frame 12 just rearwardly of the tension wheel 54.

Specifically, the lower strap end portion L is placed in the bottom portion of the tool frame 12 so that the distal end of the strap lies near, but not between, the tension wheel 54 and wear plug 64. The lower strap gripper 80 has an outwardly extending portion 88 over which the upper strap end U passes. The gripper 80 is adapted to restrain the lower strap end portion L relative to the frame and relative to the upper strap end portion U. To this end, the lower strap gripper 80 is normally biased by torsion spring 84 in the clockwise direction (as viewed in FIG. 2) so that a toothed gripping surface 86 engages the top surface of the lower strap end portion L.

As best illustrated in FIG. 1, wherein the tool is shown with the mechanisms in their elevated or strap receiving orientations, the tension wheel 54 is held upwardly away from the wear plug 64. In order to maintain the second arm 44 in the elevated position shown with the tension wheel 54 elevated, a conventional motor latch assembly 147 (only diagrammatically illustrated in FIGS. 7–11) is provided as described in the aforementioned Ericsson et al. patent (wherein the motor latch is there assigned numeral 31).

A novel latch or tension wheel pick up arm 145 is provided for initially lifting the second arm 44 upwardly until it is engaged by the motor latch assembly 147. Specifically, the tension wheel pick up arm 145 is connected to the sealing mechanism 30 for movement upwardly and downwardly with the sealer mechanism which operates in a manner fully described in the aforementioned Ericsson et al. patent. The arm 145 is biased inwardly by a suitable spring (not illustrated) to engage a projecting lug 154 on the second arm 44 when the arm 44 is in the downwardly pivoted position (FIG. 2). Further, also in the manner fully described in the Ericsson et al. patent, a pin (not illustrated) is provided to pivot the arm 145 outwardly when it reaches an elevated position so that the arm 145 is then disengaged from the lug 154 on second arm 44.

According to the present invention, the upper end of the gripper 80 has a forwardly projecting portion 160 which is adapted to overlie and be engaged by the lug 154 on the second arm 44 as the second arm 44 is pivoted about pin 46 in a clockwise direction (as viewed in FIGS. 1 and 2) when it is raised upwardly by the pick up arm 145 and maintained in the raised position by the motor latch assembly 147. This causes the gripper 80 to pivot counterclockwise (as viewed in FIGS. 1 and 2) about shaft 82 to carry the toothed gripping surface 86 above the bottom portion of frame 12 to allow the proper initial placement of the lower strap end L when the tool is first threaded with the strap 31.

The gripper 80 is maintained in the strap loading and release position illustrated in FIG. 1 until such time as the motor is unlatched so that the second arm 44 is urged downwardly to the position illustrated in FIG. 2 by the spring 48. When this occurs, the spring 84 urges the gripper 80 to pivot clockwise about shaft 82 to engage the lower strap end L. As can be seen from the relationship of the toothed gripping surface 86 and the shaft 82 relative to the lower strap end portion L, tension in the strap 31 has a self-energizing effect upon the gripper 80 to pivot the gripper 80 into even tighter engagement with the lower strap end portion L and to prevent movement of the strap portion L relative to the tool.

Figure 3:
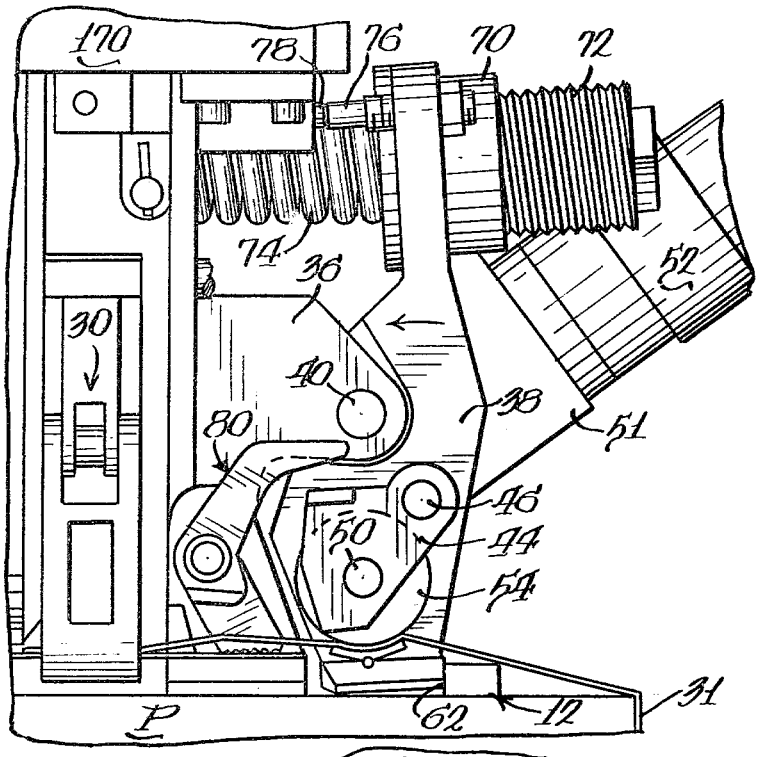
FIG. 3 is a fragmentary view, similar to FIG. 2, but showing certain mechanisms of the tool in the pivoted position that they assume when a preset tension force has been drawn in the strap loop.

During tensioning, as best illustrated in FIGS. 2 and 3, the tension wheel 54 is rotated in a clockwise direction by the motor 52 to constrict the loop of strap 31 and to draw tension in the loop. When the torque about pin 40 caused by the tension force in the loop overcomes the torque about pin 40 caused by the preset compression force of spring 74, the first arm 38 pivots relative to the frame in the counterclockwise direction bringing the engaging member 76 into contact with the valve actuating pin 78. The movement of first arm 38 against pin 78 actuates a valve 260 (FIG. 2) to terminate the tensioning in a manner that will be explained in detail hereinafter. The movement of pin 78 by arm 38 is eventually limited by the stop surface 62 on base 12 which engages the forward bottom portion of the arm 38 and prevents undue force from being exerted upon pin 78.

Thus, it is seen that the loop tension is directly sensed through a mechanical linkage and that the attainment of a preset tension level can be sensed as a response to the movement of the mechanical linkage.

In the preferred embodiment of the present invention, the motor 52 is a pneumatically operated air motor and the controls for it are located in the pneumatic system housing 170. The pneumatic system within housing 170 also controls the conventional sealer mechanism 30, the conventional cutter mechanism, and the conventional motor latch mechanism in addition to the air motor. The motor latch mechanism and the sealing assembly are actuated by conventional cylinder operators described in detail in the aforementioned Angarola and Ericsson et al. patents. The cylinder operators are only schmatically illustrated in FIGS. 7 through 11 wherein the motor latch cylinder operator is designated by numeral 172 and the sealing cylinder operator is designated by numeral 174. Further, the sealing cylinder 174 is operated by means of a sealer valve 176 which is in turn actuated by a sealing control cylinder operator 178. The operation of the sealer valve 176 is also controlled, in part, by a conventional sealer valve latch 180. All of these mechanisms are provided within housing 170, the details of their structure and operation being fully explained in the aforementioned Angarola and Ericsson et al. patents.

Figure 4:
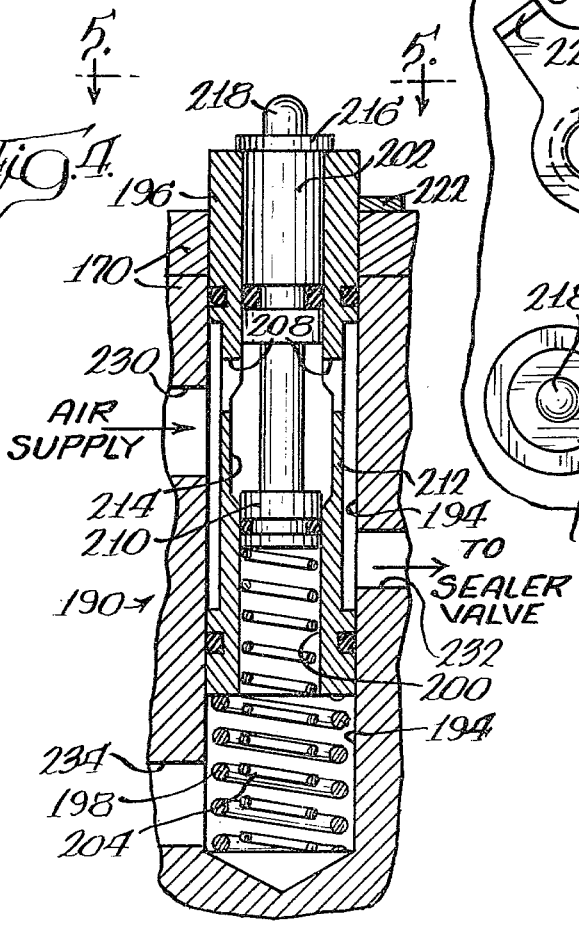
FIG. 4 is a fragmentary, cross-sectional view of the tensioner valve as provided in the tool.
Figure 5:
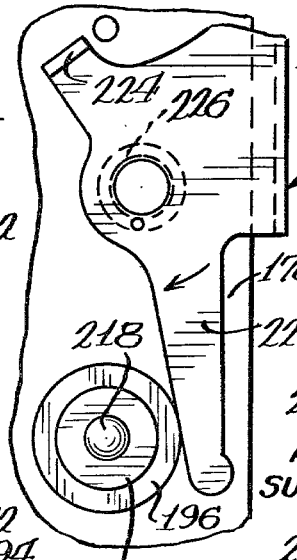
FIG. 5 is a plan view taken generally along the plane 5—5 in FIG. 4.
Figure 6:
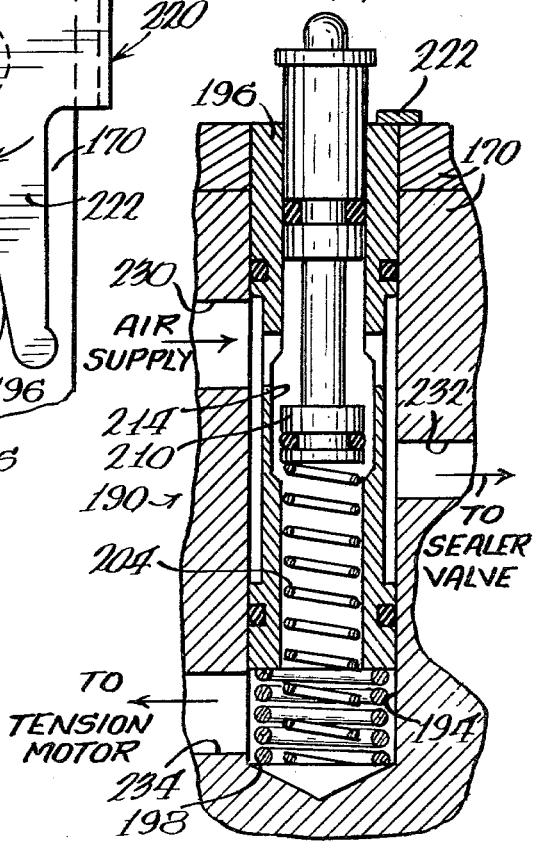
FIG. 6 is a view similar to FIG. 4 but showing the tensiner valve in a moved position for supplying air to the tension motor.

A novel tensioner valve 190 is provided in the housing 170 as illustrated in FIGS. 4, 5 and 6. The tensioner valve 190 controls the tensioning motor 52. The general arrangement of the tensioner valve 190 with respect to the sealer valve 176 and with respect to the motor latch cylinder 172, the sealing control cylinder operator 178, and the sealing cylinder operator 174 is basically illustrated in the aforementioned Angarola and Ericsson patents, slight differences in design and the omission of certain non-essential instrumentalities being made in the present disclosure.

The novel tensioner valve 190 of the present invention is shown in FIG. 4 in the first of three orientations and includes a generally cylindrical chamber 194 defined within the housing 170 and a first body 196 slidably disposed within the chamber 194. The body 196 is normally biased to a first, raised position by a first valve body spring 198. The first valve body 196 has a generally angular configuration defining a generally cylindrical interior chamber 200 in which is disposed a second valve body 200, the second valve body 202 being movable to a first raised position illustrated in FIG. 4 independently of the first valve body 196. The second valve body 202 is normally biased to the raised position by a second valve body spring 204.

The first valve body 196 defines an orifice or flow passage 208 for permitting flow or air from the chamber 194 exterior of the first valve body to the interior of the first valve body. The first valve body has a reduced wall thickness region 212 for defining an enlarged interior chamber portion 214 immediately adjacent the flow passage 208.

The second valve body includes a depending plug member 210 adapted to slide within the chamber 200 of the first valve body. The length of the second valve body 202 is such that when the first valve body 196 is urged downwardly to the lowered position illustrated in FIG. 6 the second valve body plug 210 will be located within the enlarged chamber portion 214 of the first valve body for permitting passage of air around the plug 210 into the bottom of the main cylindrical chamber 194.

The second valve body also has an annular flange 216 for projecting outwardly and over the first valve body 196 and an upwardly projecting engagement member 218 which, when forced downwardly, causes the flange 216 to move the first valve body 196 downwardly with the second valve body 202.

A spring biased latch mechanism 220 (FIG. 5) is provided with a latch arm 222 on one end and a cam wing 224 on the other end. The latch mechanism 220 is biased in the clockwise direction as viewed in FIG. 5 by a torsion spring 226 to continually urge the latch arm 222 against the first valve body 196. The latch mechanism has the same structure, and operates in the same manner, as the latch mechanism 170 illustrated and described in the aforementioned Angarola patent.

Three air passageways are provided in the housing 170 around tensioner valve 190 and are located in specific relationship with the first and second valve bodies as they are in their raised and lowered positions. Specifically, a main air supply passageway 230 is provided to supply air through the passage 208 of the first valve body when the first and second valve bodies are in either of their raised or lowered positions. Similarly, a passage 232 is provided in the housing 170 to pass air to the sealer valve 176 (FIGS. 7–11) when the first and second valve bodies are in either of their raised or lowered positions. A third passage 234 is provided in the housing 170 at the bottom of the main chamber 194 for intermittently passing pressurized air to the tension motor 52 (FIGS. 7–11) as will next be explained.

The second valve body 202 is actuated by means of a lever 240 (FIG. 2) which is depressed against the member 218 on the top of valve body 202. Movement of the valve body 202 downwardly from the raised position shown in FIG. 4 to the lowered position causes the first valve body 196 to move downwardly also to its lowered position. The air continues to flow from the main supply passage 230 through the valve and out the passage 232 to the sealer valve. Flow to the tensioner motor 52 through passage 234 remains blocked. When the first valve body 196 has reached its lowermost position as illustrated in FIG. 6 the latch arm 222, under the influence of the bias spring 226, engages the first valve body 196 and maintains it in the lowered position. Until the operating lever 240 is released, the second valve body 202 will be maintained in its lowered position, in which position the tensioner valve 190 can be said to be in its second orientation and wherein air supply is continued to be blocked from the air motor 52 by means of the second valve body plug member 210.

Only when the lever 240 is released can the second valve body 202 be urged upwardly by its spring 204 as illustrated in FIG. 6. In this position the tensioner valve is in a third orientation wherein the air flow to the motor 52 is no longer blocked by the valve member 210 and wherein air still continues to flow to the sealer valve through passage 232.

Now with reference specifically to FIGS. 7–11, it can be seen that the tensioner valve passage 234 divides into two conduits, conduits 252 and 254, with conduit 254 supplying the tensioning motor 52 and with conduit 252 supplying the motor latch cylinder operator 172. A branch conduit 256 off of the conduit 252 supplies the sealing control cylinder operator 178. A tension limit valve 260 is connected in the conduit 256 for controlling, in an on-off mode of operation, a flow of pressurized air to the sealing control cylinder operator 178. The tension limit valve 260 is a conventional on-off type valve biased by a suitable means, such as spring 262, to a first position for blocking air flow to the sealing control cylinder operator 178 and permitting exhaust thereof to atmosphere from a second position for passing air to actuate the sealing control cylinder operator 178. The valve 260 is movable from the first position to the second position by the pivoting of the first arm 38 against the valve actuating stem 78 when the preset tension level is attained in the strap loop in the manner previously described.

The tension limit valve thus controls the actuation of the sealing control cylinder operator 178 which in turn controls the operation of the sealer valve 176. The sealer valve 176 is a conventional spool-type valve which is constructed as disclosed and illustrated in the aforementioned Angarola patent. Briefly, it is biased to a raised position by a spring 177 and is adapted to be latched in a lowered position by the conventional spring-biased latch 180. The valve 176 is automatically unlatched when the piston in the sealing cylinder operator has moved to fully close the jaws about the seal.

Briefly, the sealer valve 176 is movable by the sealing control cylinder operator 178 between a raised position in which air is passed out of the valve through a passage 270 to the underside of the piston in the sealing cylinder operator 174 and in which the portion of the cylinder above the piston is exhausted through a passage 272 to atmosphere. In the lowered position, the sealer valve 176 exhausts the area beneath the piston in the sealing cylinder operator 174 and permits pressurization of the area above the piston to actuate the sealing jaws for crimping the seal about the overlapping strap segments.

In the manner fully described in the aforementioned Angarola patent, the sealing control cylinder operator 178 is also adapted to engage the cam wing 224 on the tensioner valve latch mechanism 220 to pivot the latch arm 222, against the urging of bias spring 226, in a counterclockwise position as viewed in FIG. 5 to unlatch the upwardly biased first valve body 202.

Figure 7:
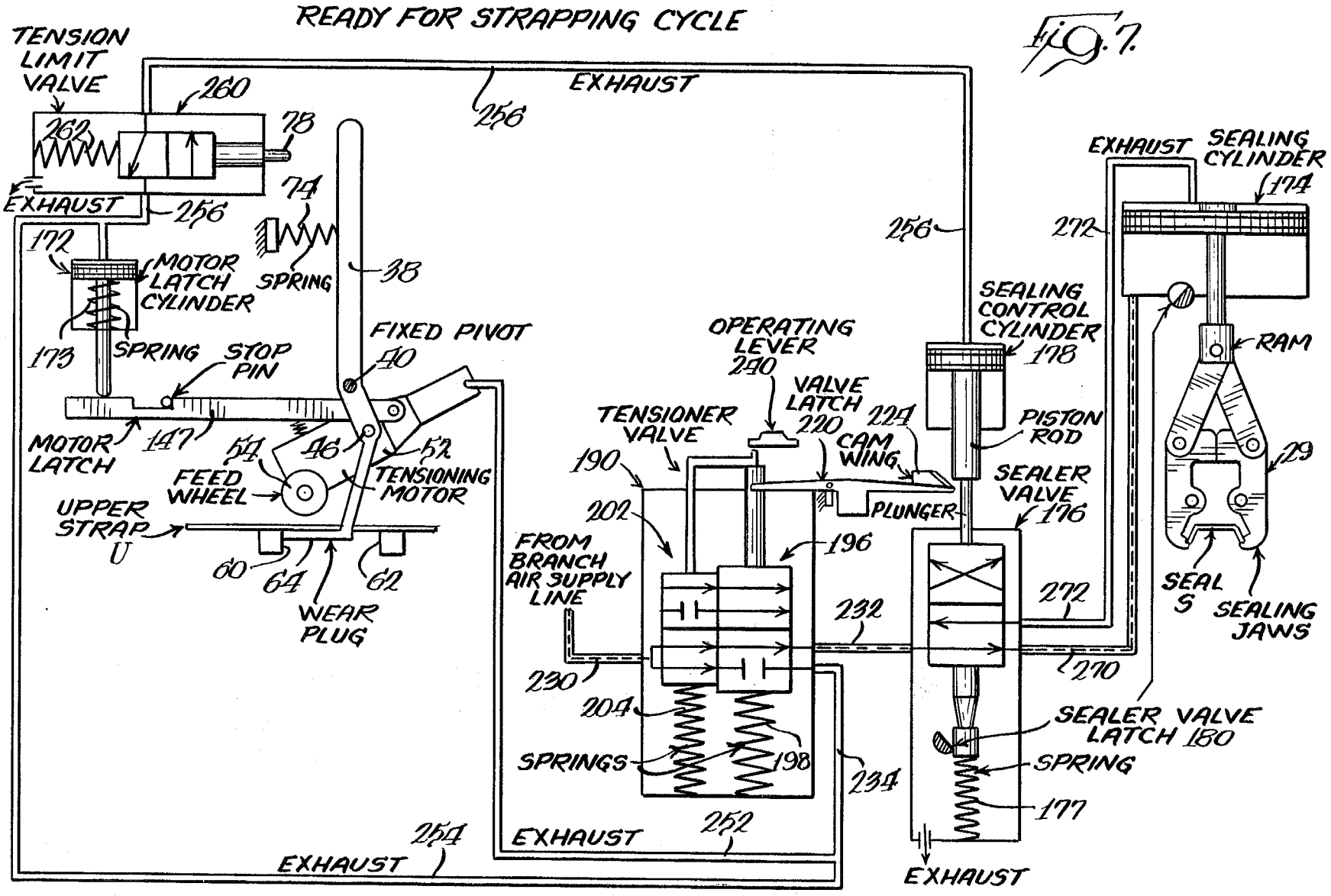
FIG. 7 is a schematic pneumatic circuit diagram showing the pneumatic control mechanisms by means of which the tool is operated in the condition wherein the tool is ready to begin a strapping cycle.

In operation, the strapping tool 10 is normally rendered in a position ready to receive the strapping when air is supplied to the tool and where the various mechanisms and pneumatically controlled valves and operators are in the condition illustrated in FIG. 7. At this point, the operating lever 240 has not been depressed so that the tensioner valve 190 is in the first orientation wherein pressurized air passes through to the sealer valve 176. The sealer valve 176 is in its normal raised position biased by spring 177 so that pressurized air is maintained below the piston in the sealing cylinder operator 174 to hold the sealing jaws 29 open. The remaining pneumatic passages and conduits exhaust to atmosphere. In this respect, it should be noted that the tensioning motor 52, being a typical pneumatically operated vane type motor, is continually vented to atmosphere.

After the overlapping strap portions U and L have been properly placed about the package P and in the tool 10, the operating lever 240 is initially depressed to move the tensioner valve 190 from the first orientation to the second orientation wherein the first valve body 196 and second valve body 202 are both in the lowered position which permits continued passage of air to the sealer valve 176 but which continues to prevent flow of air through passage 234 to the tensioning motor 52 or to the motor latch cylinder 172.

Figure 8:
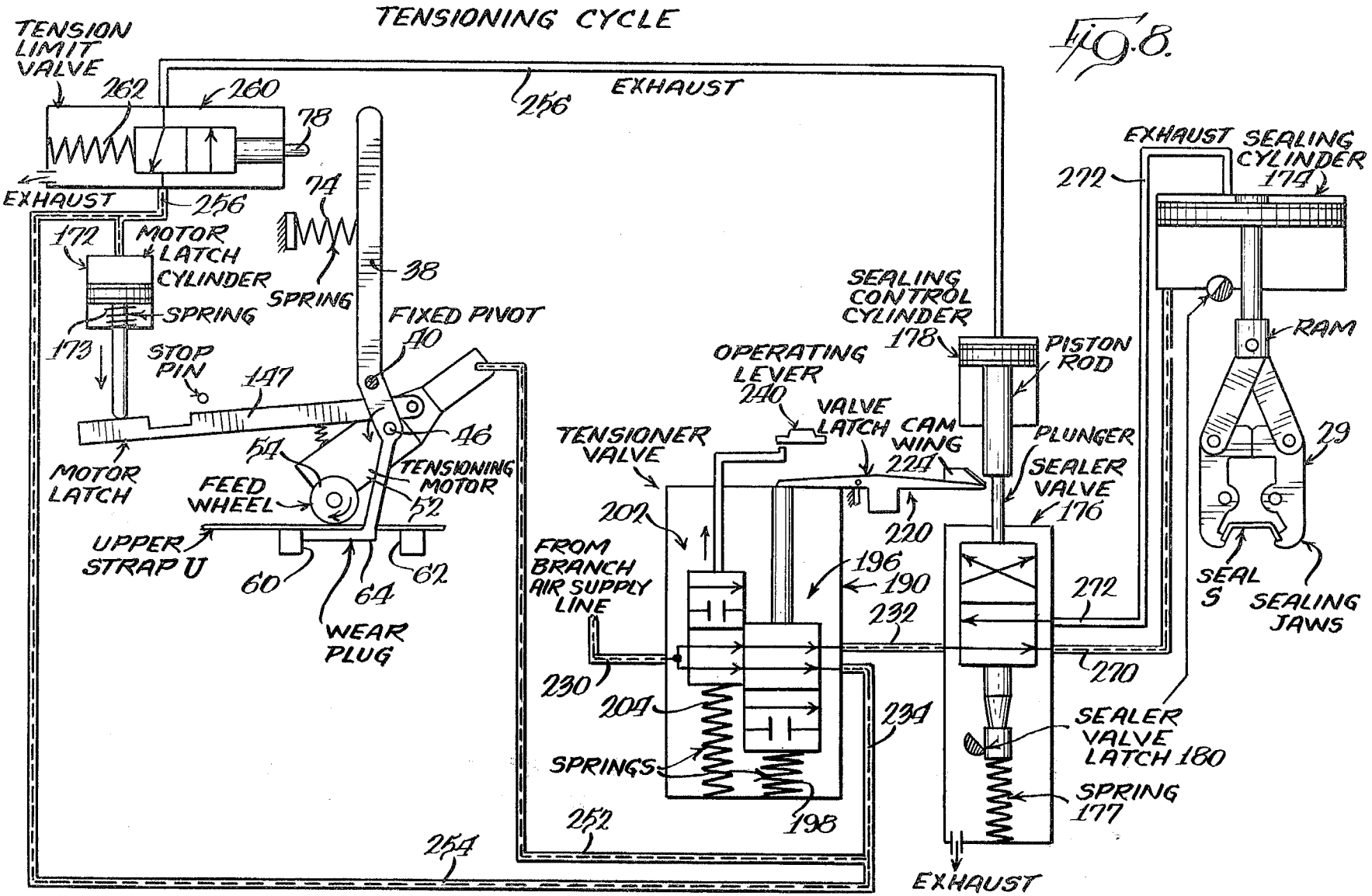
FIG. 8 is a diagram similar to FIG. 7, but showing the mechanisms in the condition occurring during the tensioning cycle.

When the operator releases the lever 240, the first valve body 196 has been latched in the lowered position illustrated in FIG. 6 and the second valve body 202 is biased to the raised position so that the pressurized air can now flow through the tensioner valve 190 to the motor 52 and to the motor latch cylinder operator 172 as illustrated in FIG. 8. The motor latch cylinder operator 172 is thus actuated to release the motor latch so that the tensioning motor 52 is rotated on the second arm 44 (FIG. 2) under the influence of spring 48 into engagement with the upper strap end portion U. Additionally, the tension wheel 54 is rotated (clockwise as viewed in the Figures) to draw tension in the strap loop.

Figure 9:
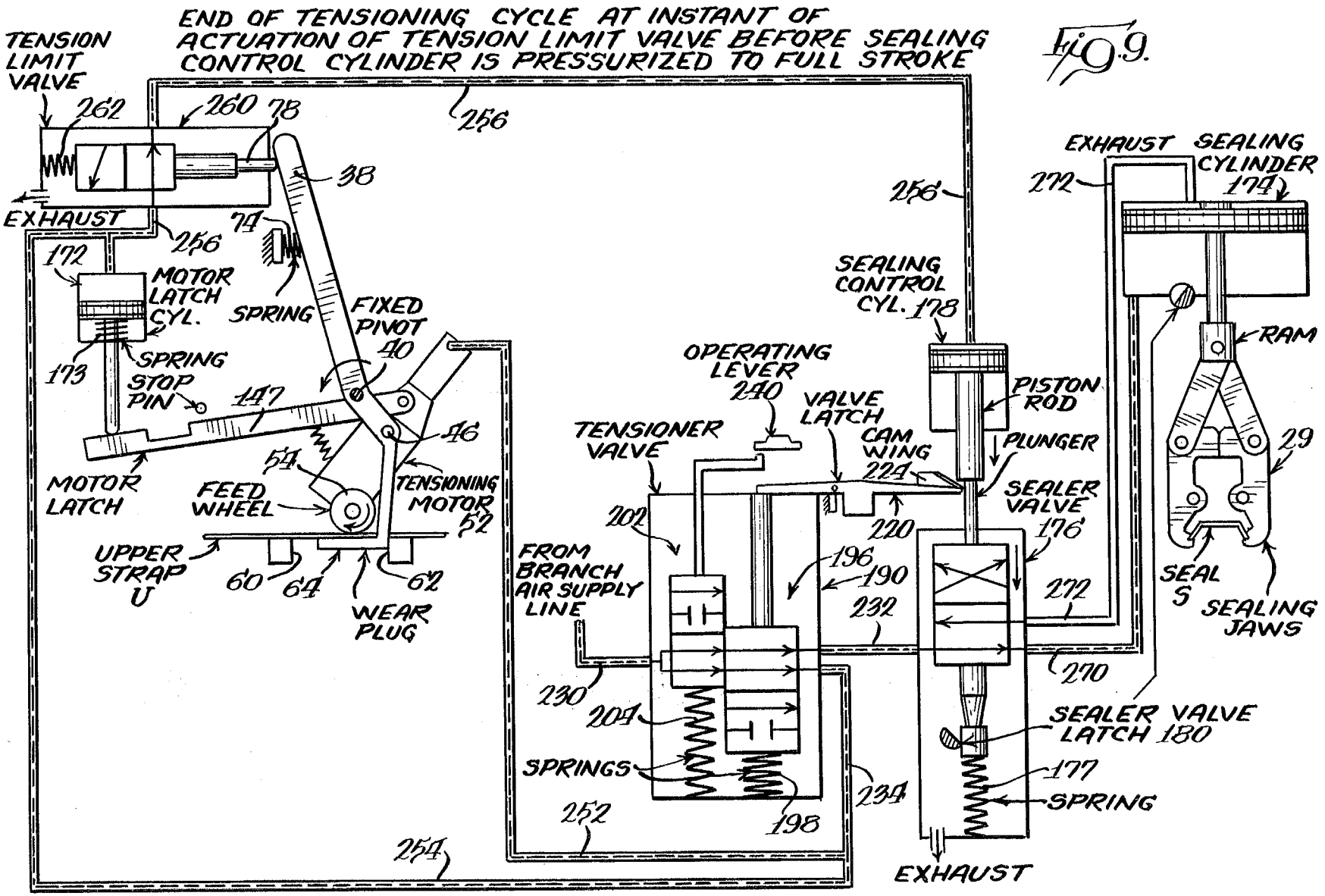
FIG. 9 is a diagram similar to FIG. 7, but showing the mechanisms in the condition occurring at the end of the tensioning cycle just before the control mechanisms have been actuated to terminate tensioning.
Figure 10:
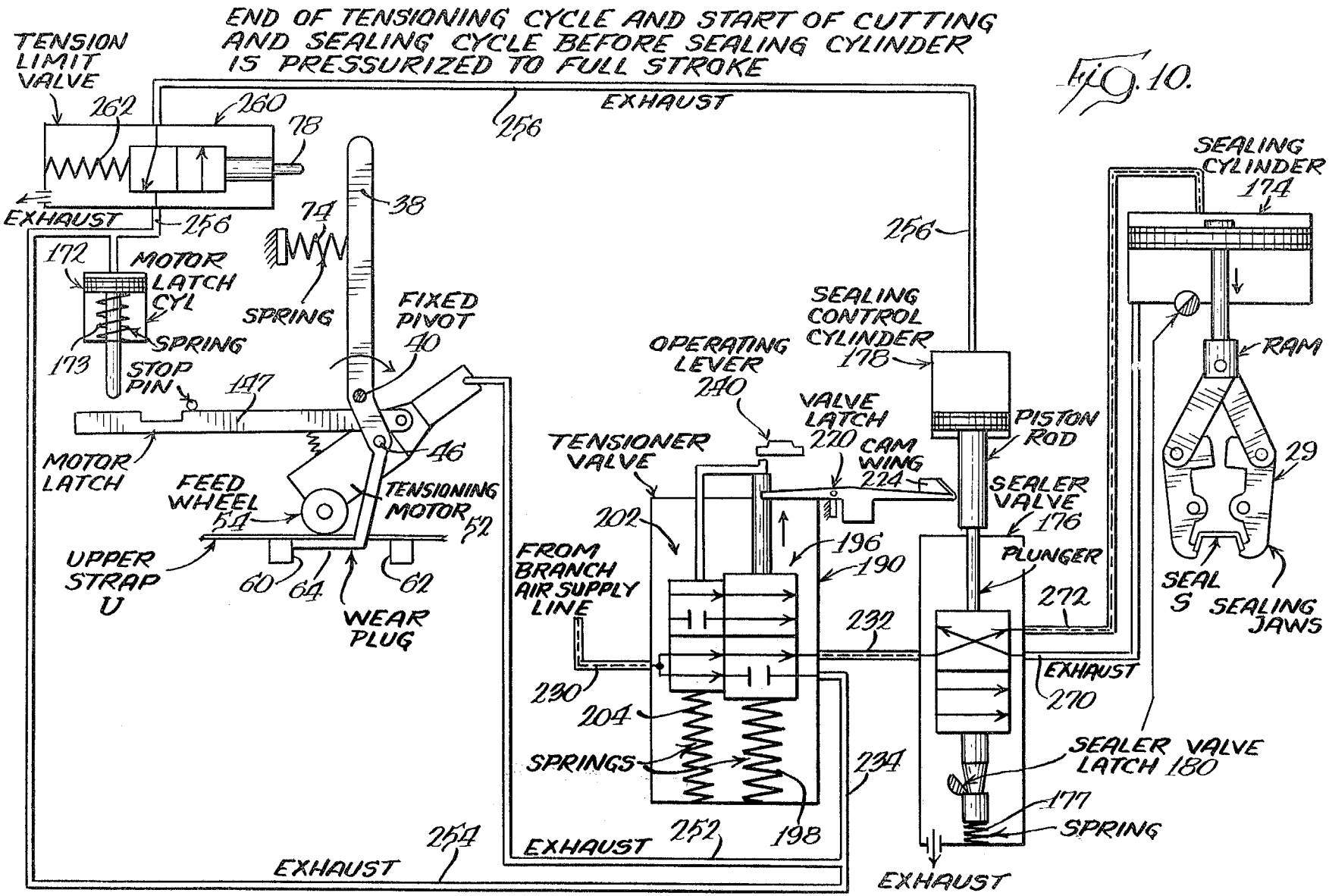
FIG. 10 is a diagram similar to FIG. 7 but showing the mechanisms at the end of the tensioning cycle and at the start of the cutting and sealing cycle.

When the preset tension level is reached, the spring 74 is overcome (FIG. 3) and the first arm 38 moves the tension limit valve 260 to the position illustrated in FIG. 9 whereupon pressurized air is introduced through the tension limit valve 260 to the sealing control cylinder operator 178. FIG. 9 illustrates this step with the sealing control cylinder not yet fully pressurized so that the piston rod is not yet moving latch 220. The tensioner valve 190 is thus still shown in the third orientation wherein pressurized air is still being supplied to the motor latch cylinder, tensioning motor, and tension limit valve. As illustrated in FIG. 10, under full pressure the sealing control cylinder operator 178 then moves the rod against the cam wing 224 to unlatch the tensioner valve 190 and also moves the sealer valve to its second (lowered) position for supplying air to the top of the sealing cylinder operator 174.

As soon as the tensioner valve 190 returns to the normal, first orientation wherein both the first valve body 196 and the second valve body 202 are in the raised positions, flow of air to the motor latch cylinder, tension limit valve, and tensioning motor is terminated. Termination of the air flow to the tensioning motor results in a slowly decreasing torque created by the strap loop tension acting through pivot arm 38. When this decreasing torque becomes less than the torque applied by spring 74, pivot arm 38 is urged to pivot in the clockwise direction about pin 40. A slight pivotal movement will cause the release of the tension limit valve 260 so that the tension limit valve is returned under the urging of its spring 262 to its first position. Owing to the termination of the flow of air to the tension limit valve 260, the air flow to the sealing control cylinder 178 is blocked and the pressure within the sealing control cylinder 178 is exhausted to atmosphere through valve 260 as illustrated in FIG. 10. At the same time as the tensioner valve 190 returns to the normal, first orientation, the air within the passages 234, 252, 254 and within the motor latch cylinder operator 172 is exhausted through the tensioning motor vane drive mechanism. This, of course, permits the motor latch cylinder operator 172 to return to its normal raised position under the influence of the spring 173.

Figure 11:
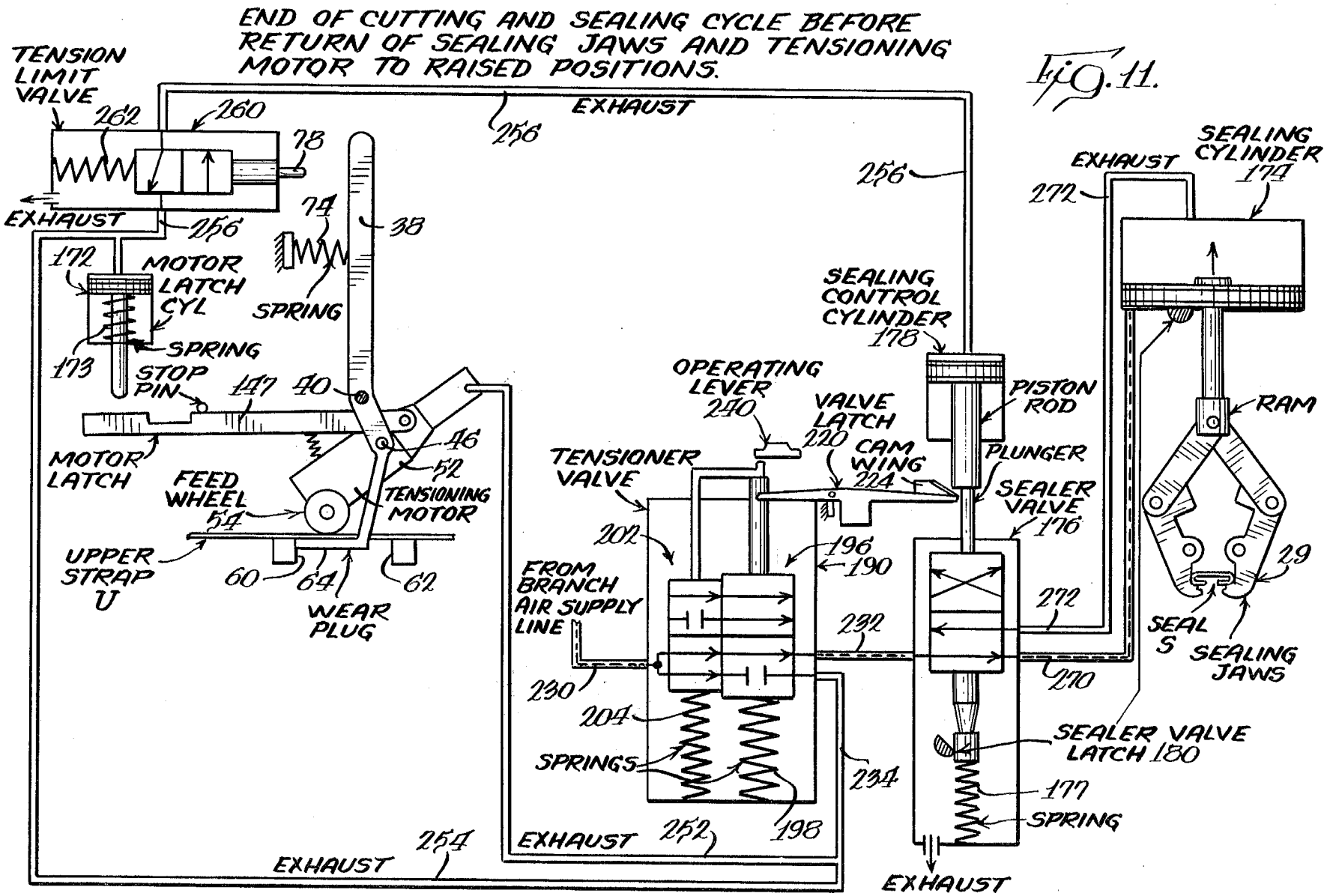
FIG. 11 is a diagram similar to FIG. 7, but showing the mechanisms in the condition occurring when the sealing jaws are fully crimping the seal.

When the sealer valve 176 is moved to its lowered position as illustrated in FIG. 10, the valve is latched in the conventional manner by the sealer valve latch 180 and prevented from returning to its raised position until the piston in the sealing cylinder operator 174 has fully closed the sealing jaws and released the latch at the downwardmost movement of the piston in the cylinder as illustrated in FIG. 11. At this point, the sealer valve 176 returns to its unlatched position to permit the air to pressurize the underside of the piston in the sealing cylinder operator 174 to return the sealing jaws 29 to the open position.

The trailing portion of the strap may be cut by a conventional cutter blade 33 operating in conjunction with the sealing mechanism 30.

After the cutting of the strap and the crimping of the seal about the strap, the feed wheel pick up arm 145 (FIG. 1) is carried upwardly with the sealer mechanism 30. This lifts the motor and feed wheel upwardly along with the lower strap gripper 80. At the point of upwardmost movement of the sealer mechanism 30 during the return of the sealing jaws to the open position, the pick up arm 145 is again released and the motor 52 is held in the raised position by the conventional motor latch mechanism. The tool is then ready for another strapping cycle.

From the foregoing, it will be observed that numerous variations and modifications may be effected without departing from the true spirit and scope of the novel concept of the invention. It is to be understood that no limitation with respect to specific apparatus illustrated herein is intended or should be inferred. It is, of course, intended to cover by the appended claims all such modifications as fall within the scope of the claims.

What is claimed:

1. In a strapping tool for tensioning a loop of strapping having overlapping end portions about an article;

a frame;

means for gripping one of the two strap portions and restraining it from movement relative to said frame;

a first arm pivotally mounted to said frame for pivoting movement in a first direction and in a second, opposite direction;

first biasing means for biasing said first arm in said first direction;

a second arm pivotally mounted on said first arm for pivoting movement in the first and second directions away from and toward the other of said two strap portions, respectively;

second biasing means for biasing said second arm in said second direction;

tensioning means connected to and mounted for movement with said second arm for engaging the said other strap portion and effective when operated for progressively applying tension to the loop whereby, at a predetermined tension level, the loop tension reaction force on said first arm urges said first arm to overcome said first biasing means and pivot relative to said frame in said second direction; and control means responsive to the pivoting movement of said first arm in said second direction for terminating the operation of said tensioning means at the predetermined loop tension level.

2. The tool in accordance with claim 1 in which said gripping means includes a third arm pivotally mounted on said frame for pivoting movement in said first and second directions, said third arm having a gripping member on one end adapted to contact said one of two strap portions, said gripping means further including a third means for biasing said third arm in said first direction to force said gripping member against said one strap portion, and said third arm also having an engagement finger for engaging said second arm whereby pivoting movement of said second arm in said first direction pivots said gripping member away from said one strap portion.

3. The apparatus in accordance with claim 2 in which said apparatus further includes a latch means mounted for movement relative to said frame between a lowered position and a raised position relative to said two strap portions for engaging and pivoting said second arm in said first direction to raise said tensioning means and said gripping member out of engagement with said strap portions when said latch means is moved to said raised position.

4. The tool in accordance with claim 1 in which said first biasing means includes a first arm spring having a first end abutting a portion of said frame and an end member engaging the second end of said first arm spring and adjustably connected with said first arm whereby the location of the connection between said first arm and said end member can be varied along the longitudinal axis of said first arm spring relative to said first arm spring second end to vary the preset compression of said first arm spring.

5. The tool in accordance with claim 4 in which said frame further includes a first arm first stop means for limiting the pivoting movement of said first arm in said first direction and a first arm second stop means for limiting the pivoting movement of said first arm in said second direction.

6. The tool in accordance with claim 5 in which said frame includes a forward portion having two laterally projecting surfaces defining therebetween a space for receiving a portion of said first arm, one of said surfaces defining said first arm first stop means and the other of said surfaces defining said first arm second stop means.

7. The apparatus in accordance with claim 1 in which said tensioning means is pneumatically operated; in which said tool includes an air supply line through which pressurized air is furnished to said tensioning means; and in which said control means includes means responsive to the pivoting movement of said first arm in said second direction for effecting the blocking of the flow of air through said air supply line to said tensioning means whereby the tensioning of said loop is terminated.

8. The tool in accordance with claim 1 in which said tensioning means includes an air-operated motor and first air supply line connected thereto through which pressurized air can be supplied to operate said motor; in which said tensioning means includes (1) a tensioner valve means connected in said first air supply line effective in one orientation for blocking the supply of air to said motor and effective in another orientation for passing air to operate said motor, (2) means for biasing said tensioner valve means to said one orientation for blocking the supply of air to said motor; and (3) a latch means for maintaining said tensioner valve means in said other orientation for passing air to operate said motor.

9. The tool in accordance with claim 8 in which said control means includes (1) a pneumatically actuated release means for releasing said latch means, (2) a second air supply line through which pressurized air is furnished to said pneumatically actuated release means, (3) a tension limit valve connected in said second air supply line and movable by said first arm pivoting in said second direction from a first position blocking air flow to said release means to a second position passing air to actuate said release means, and (4) means for biasing said tension limit valve to said first position, whereby, when the tension limit valve is moved against the urging of its biasing means to said second position by said first arm, said release means is actuated to release said latch means so that said tensioner valve means returns to said one orientation for blocking air to said air motor and thus terminating the tensioning of said loop.

10. The tool in accordance with claim 1 in which said tensioning means includes an air-operated motor and a first air supply line connected thereto through which pressurized air can be supplied to operate said motor; in which said tensioning means includes a manually operable tensioner control valve connected in said first air supply line and including first and second valve bodies relatively movable to three orientations and effective in a first orientation to block flow to said motor, effective in a second orientation to continue to block flow to said motor, and effective in a third orientation to pass air to said motor.

11. The tool in accordance with claim 10 in which said tensioner control valve further includes a first valve body spring means yieldingly urging said first valve body to a first raised position and in which said tensioner valve means includes a second valve body spring means yieldingly urging said second valve body to a raised position independently of said first valve body, said raised positions of said first and second valve bodies together defining said first orientation in which the air supply to said motor is blocked; said first valve body adapted to be moved from said raised position against the urging of said first valve body spring means to a lowered position and said second valve body adapted to be moved from said raised position against the urging of said second valve body spring means to a lowered position, said second valve body having an engaging means for engaging said first valve body for moving said first valve body to its lowered position when said second valve body is moved to its lowered position.

12. The tool in accordance with claim 11 in which said tensioning means further includes latch means for latching said first valve body when said first valve body moves to said lowered position and further including a latch biasing means for biasing said latch means to latch said first valve body in said lowered position whereby, when force is applied to move said second valve body from its raised position to its lowered position, said first valve body is forced by said second valve body to its lowered position and defines with said lowered second valve body said second orientation in which the air supply to said motor is continued to be blocked and whereby said latch means is biased to latch said first body in said lowered position and whereby, when said force is removed from said second valve body, said second valve body is raised by said second body spring means to said raised position and defines with said lowered and latched first valve body said third orientation for supplying air to said motor.

13. The tool in accordance with claim 12 further including a second air supply line for supplying pressurized air and a latch release control cylinder connected in said second air supply line and operative when supplied with air through said second air supply line to release said latch means from said first valve body; said tool further including a tension limit valve connected in said second air supply line upstream of said latch release control cylinder and movable by said first arm pivoting in said second direction from a first position blocking air flow to said latch release cylinder to a second position passing air to actuate said latch release cylinder whereby, when said tension limit valve is moved to said second position by said first arm, said latch means is released and said tensioner control valve first valve body returns under the influence of said first valve body spring means to said raised position and defines with said raised second valve body said first orientation wherein the air supply to said motor is again blocked and the tensioning is thus terminated.

14. A tension sensing mechanism for a strapping tool for tensioning a loop of strapping having first and second strap portions about an article, said tool having a frame and tensioning means supported from said frame for engaging said first strap portion and effective when operated for drawing said first strap portion relative to the second strap portion to progressively constrict and tension the loop, said tension sensing mechanism comprising:

means for gripping said second strap portion and restraining it from movement relative to said frame and said first strap portion;

a first arm pivotally mounted to said frame for pivoting movement in a first direction and in a second, opposite direction;

first biasing means for biasing said first arm in said first direction;

a second arm pivotally mounted on said first arm for pivoting movement in the first and second directions away from and towards said strap portions, respectively;

second biasing means for biasing said second arm in said second direction;

said tensioning means connected with said second arm on said first arm for being pivoted with said second arm to engage said first strap portion and for being operated to tension the loop when said second strap portion is restrained by said gripping means whereby, at a predetermined tension level, the loop tension reaction force transmitted from said second arm to said first arm urges said first arm to overcome said first biasing means and pivot relative to said frame in said second direction; and control means responsive to the pivoting movement of said first arm in said second direction for terminating the operation of said tensioning means at the predetermined loop tension level.

15. The apparatus in accordance with claim 14 in which said tensioning means includes a feedwheel adapted to contact said first strap portion and an air-operated motor drivably connected to said feedwheel to rotate said feedwheel to pull said first strap portion in the direction to tension said loop; in which said tool includes a first air supply line through which pressurized air is furnished to said air motor; and in which said control means includes means responsive to the pivoting movement of said first arm in said second direction for effecting the blocking of the flow of air through said first air supply line to said air motor whereby the tensioning of the loop is terminated.

16. The tool in accordance with claim 15 in which said tensioning means further includes a tensioner valve means connected in said first air supply line effective in one orientation for blocking the supply of air to said motor and effective in another orientation for passing air to operate said motor, said tool including means biasing said tensioner valve to said orientation for blocking the supply of air to said motor; in which said tensioning means further includes latch means for maintaining said tensioner valve means in said orientation for passing air to operate said motor during tensioning; and in which said control means includes (1) a pneumatically actuated release means for releasing said latch means, (2) a second air supply line through which pressurized air is furnished to said pneumatically actuated release means, and (3) a tension limit valve connected in said second air supply line and movable by said first arm from a first position blocking air flow to said release means to a second position admitting air to actuate said release means, said tension limit valve including means for biasing said limit valve to said first position.

* * * * *

UNITED STATES PATENT OFFICE

CERTIFICATE OF CORRECTION

Patent No. 4,282,907 Dated August 11, 1981

Inventor(s) Robert J. Massion, Peter Lems and Robert J. Nix

It is certified that error appears in the above-identified patent and that said Letters Patent are hereby corrected as shown below:

Col. 3, line 26: "tensiner: should be --tensioner--.

Col. 4, line 57: "bifuracated" should be --bifurcated--.

Col. 7, line 19: "schmatically" should be --schematically--.

Col. 7, line 49:"angular" should be -- annular --.

Col. 7, line 57: "or" should be -- of --.

Col. 8, line 6: omit "for"

Signed and Sealed this

Eighth Day of December 1981

[SEAL]

Attest:

GERALD J. MOSSINGHOFF

Attesting Officer

Commissioner of Patents and Trademarks